US006662730B1

(12) United States Patent
Canini et al.

(10) Patent No.: US 6,662,730 B1
(45) Date of Patent: Dec. 16, 2003

(54) DEVICE FOR DRIVING A VEHICLE AND IN PARTICULAR A RAILWAY VEHICLE

(75) Inventors: Jean-Marc Canini, Aibes (FR); Raymond Michaux, Solre le Chateau (FR)

(73) Assignee: Jeumont S.A., Courbevoie (FR)

( * ) Notice: Subject to any disclaimer, the term of this patent is extended or adjusted under 35 U.S.C. 154(b) by 0 days.

(21) Appl. No.: 09/869,707

(22) PCT Filed: Dec. 22, 1999

(86) PCT No.: PCT/FR99/03261

§ 371 (c)(1),
(2), (4) Date: Sep. 27, 2001

(87) PCT Pub. No.: WO00/40446

PCT Pub. Date: Jul. 13, 2000

(30) Foreign Application Priority Data

Dec. 30, 1998 (FR) ..... 98 16673

(51) Int. Cl.[7] ..... B61C 1/00

(52) U.S. Cl. ..... 105/133; 105/136; 105/138; 105/140; 105/96.1; 105/96

(58) Field of Search ..... 105/96, 96.1, 97, 105/98, 113, 108, 131, 132, 133, 136, 137, 138, 140; 180/65.1, 65.5, 65.6

(56) References Cited

U.S. PATENT DOCUMENTS

| | | | | | |
|---|---|---|---|---|---|
| 452,621 | A | * | 5/1891 | Short | 105/136 |
| 478,477 | A | * | 7/1892 | Short | 105/139 |
| 2,027,218 | A | | 1/1936 | Armington | |
| 5,443,130 | A | * | 8/1995 | Tanaka et al. | 180/65.6 |
| 5,620,387 | A | * | 4/1997 | Janiszewski | 475/150 |
| 5,718,300 | A | * | 2/1998 | Frost | 180/297 |

FOREIGN PATENT DOCUMENTS

| | | | |
|---|---|---|---|
| FR | 550836 | | 3/1923 |
| JP | 178112 | * | 6/2001 |

* cited by examiner

*Primary Examiner*—Mark T. Le
(74) *Attorney, Agent, or Firm*—Connolly Bove Lodge & Hutz LLP

(57) ABSTRACT

An electric motor is placed around the axle of a vehicle but includes a rotor that does not contact the axle. A drive element is fastened to the axle and extends radially from the axle. The drive element for driving the axle is coaxially fastened to the axle but located laterally with respect to the electric motor. The rotor includes a disk that directly engages elements in a peripheral region of a drive element disk, the engagement occurring at a point remote from the axis of the axle.

7 Claims, 4 Drawing Sheets

DEVICE FOR DRIVING A VEHICLE AND IN PARTICULAR A RAILWAY VEHICLE

FIELD OF THE INVENTION

The invention relates to a drive device for a vehicle and especially for a railroad vehicle. The invention also applies to the drive for road vehicles.

BACKGROUND OF THE INVENTION

Vehicles, especially railroad vehicles, which comprise a structure mounted on at least one driving axle fitted with wheels which is driven in rotation by an electric motor, such as a radial flux motor, are known.

The motor, which is fixed to the structure of the vehicle and possibly supported by the axle via a bearing, comprises a stator and a rotor mounted so as to rotate with respect to the stator. The axle may be driven in rotation by the rotor via gearwheels constituting a gear reducer. One of the gearwheels, which is fastened to the axle, constitutes a drive element extending radially around the axle and has toothing which meshes with the pinion which may be fastened to the rotor.

In such a drive device, the motor is inserted vertically between the vehicle structure and the axle, thereby requiring the vehicle structure to be placed at a certain height above the axle. Furthermore, the use of a gear reducer has certain drawbacks, since it increases the overall size of the drive device and has difficulty in absorbing the in-service displacements between the vehicle structure and the axle.

It has been proposed to use drive devices for railroad or road vehicles comprising an electric motor placed around the axle of the vehicle, or located in the central part of a wheel.

In the case of such drive devices, the rotor may be in direct engagement with the axle or with the wheel. Direct driving of the axle or the wheel is generally performed by an internal part of the motor, generally by an internal part of the rotor.

The rotor may also constitute part of the wheel.

In all cases, only a few possibilities for movement between the axle and the drive motor remain.

In certain cases, the axle or wheel is driven via a gear reducer or a differential but, in this case, the drawbacks mentioned above in the case of railroad vehicles, whose drive device has a gear reducer, are again found.

In the work "Histoire de la traction électrique (History of Electric Traction)" volume 1, chapter IX, pages 373–395, by Machefert Tssin et al., électrique (History of Electric Traction)" volume 1, chapter IX, pages 373–395, by Machefert Tssin et al., *La vie du rail* (Rail Life), Paris 1980, there is description of gearless transmissions providing the electric traction of a railroad vehicle, based on a motor whose armature may be mounted on a hollow shaft allowing passage and movement of an axle of the vehicle and drives at least one wheel of the vehicle via a compliant transmission.

FR-A-550836 describes a device for driving a vehicle along rails, comprising an electric motor mounted around an axle of the vehicle with the possibility of movement of the axle, the rotor of the motor being mounted on a first hollow shaft and driving the axle in rotation via the first and second hollow shafts, through which the axle passes, and via two universal joints.

BRIEF DESCRIPTION OF THE INVENTION

It is therefore an object of the invention to provide a device for driving a vehicle comprising a structure mounted on at least one driving axle fitted with wheels, which includes at least one electric motor supported by the structure of the vehicle and having a stator and a rotor mounted so as to rotate with respect to the stator, placed around the axle but not in contact with the axle, and a drive element fastened to the axle extending radially from the axle, this device allowing the vehicle to be driven very satisfactorily, with the possibility of movement between the axle and the motor.

For this purpose, the element for driving the axle is located laterally with respect to the electric motor, along the axial direction of the axle, and the rotor is fastened to drive means designed to engage directly with the element for driving the axle in rotation.

In order to make the invention clearly understood, a drive device according to the prior art and a drive device according to the invention and according to several embodiments will now be described by way of example.

BRIEF DESCRIPTION OF THE FIGURES

FIG. 1 shows a prior art device for driving a railroad vehicle which comprises an axle 1 on which wheels 3 designed to move along rails 4 are mounted.

DETAILED DESCRIPTION OF THE FIGURES

The axle 1 is fixed beneath the structure 2 of the railroad vehicle by means of Known suspension elements (not shown in the figure).

Figure 1:
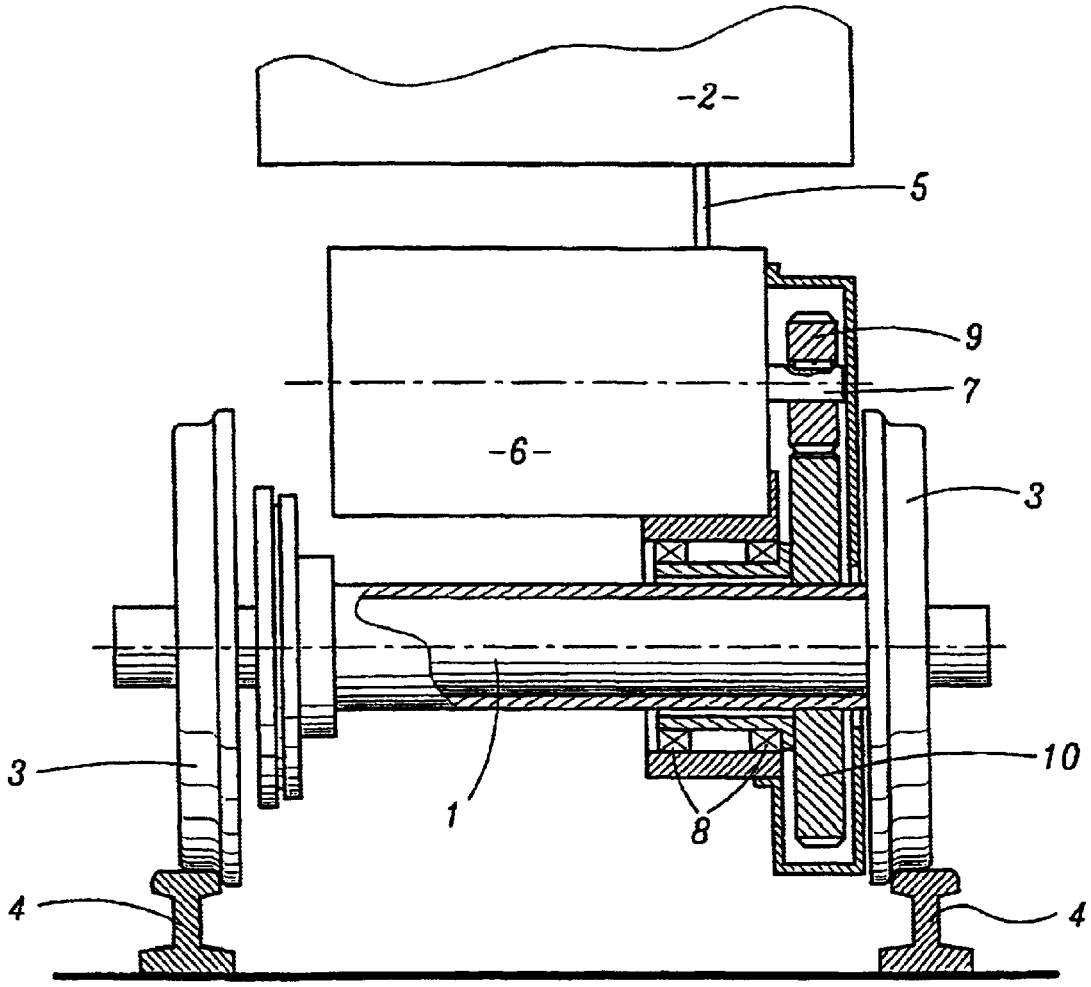
Prior Art FIG. 1
FIG. 1 a schematic end view in partial cross section of a drive device according to the prior art.

The drive device comprises a radial flux electric motor 6 which is fixed to the structure 2 of the vehicle by known fixing means 5 and which is supported via a bearing 8 by the axle 1 of the vehicle. The axle 1 is fastened to a gearwheel 10 which is placed around the axle and which extends radially around the axle. The gearwheel 10 has toothing on its peripheral surface which meshes with a pinion 9 fastened to the shaft 7 of the motor 6. Use of a drive device as shown in FIG. 1 means that the structure 2 of the vehicle must be located a substantial distance above the axle 1, in order to be able to house the motor 6 and the gear reducer consisting of the gearwheels 9 and 10. In addition, the assembly consisting of the motor and the gear reducer rests partially on the axle, so that the displacements and vibrations of the axle are transmitted to the gear reducer and to the motor.

Figure 2:
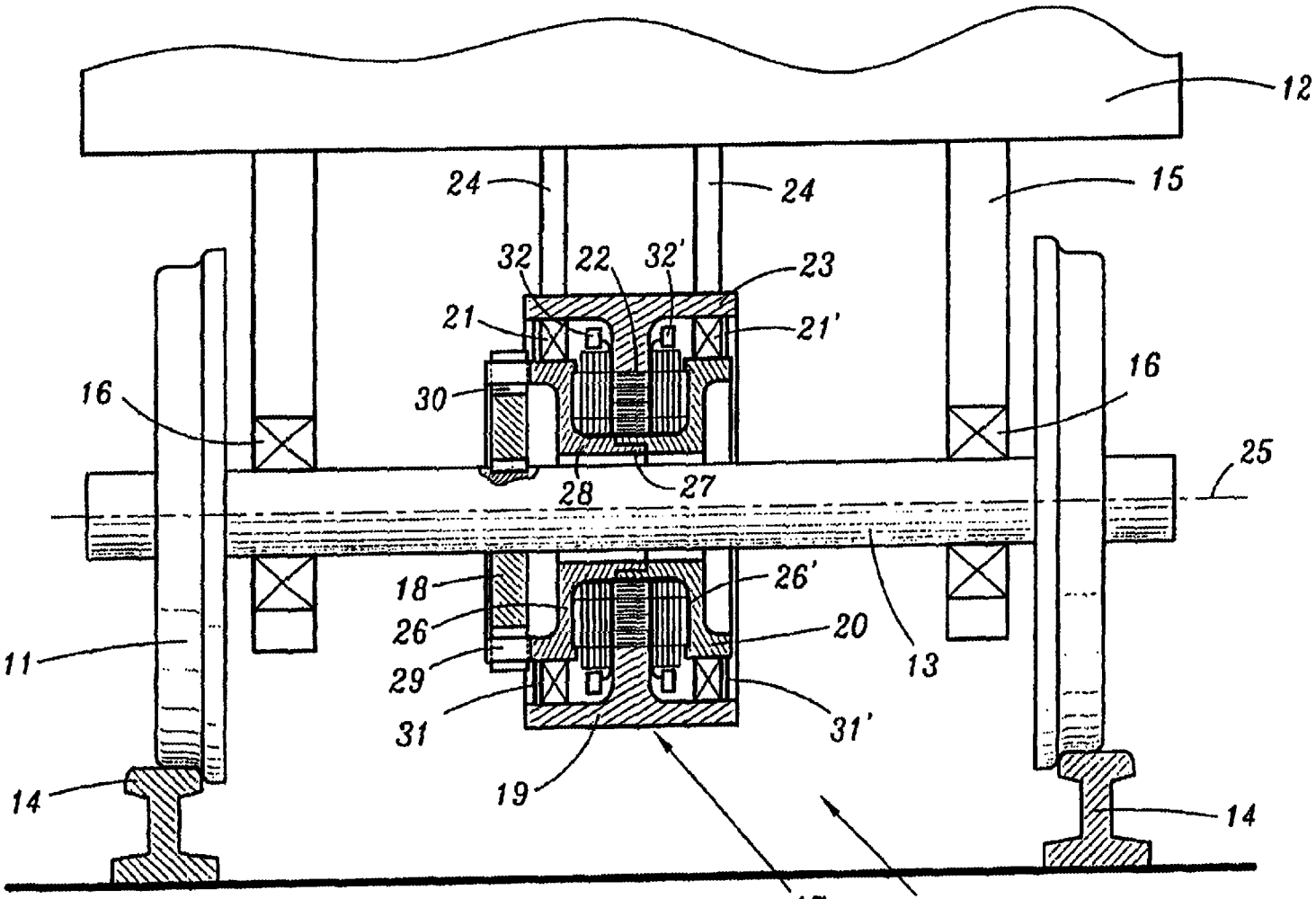
FIG. 2 is an end view in partial cross section of a drive device according to the invention in a first embodiment.
Figure 3:
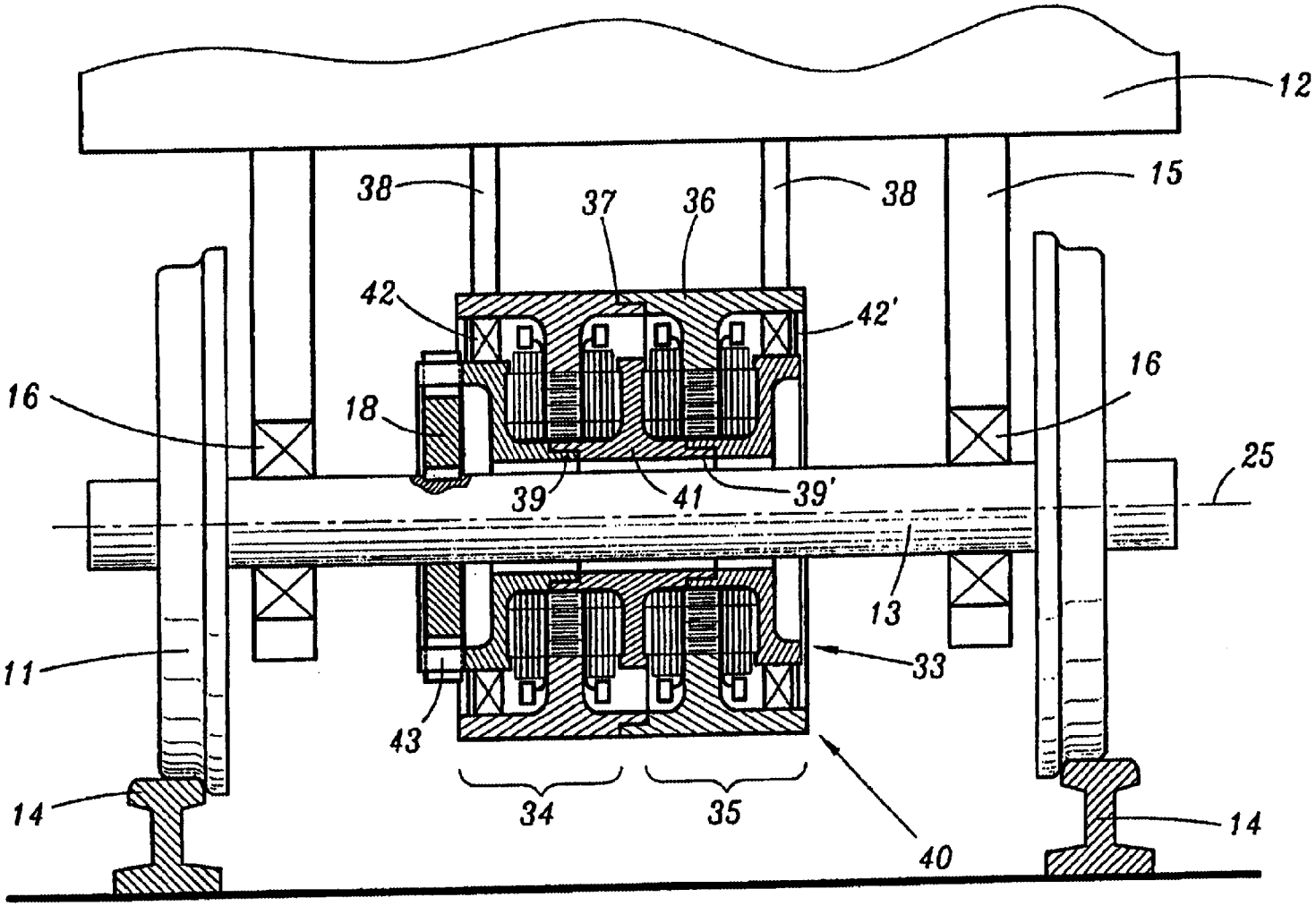
FIG. 3 is an end view in partial cross section of a device according to the invention in a second embodiment.
Figure 4:
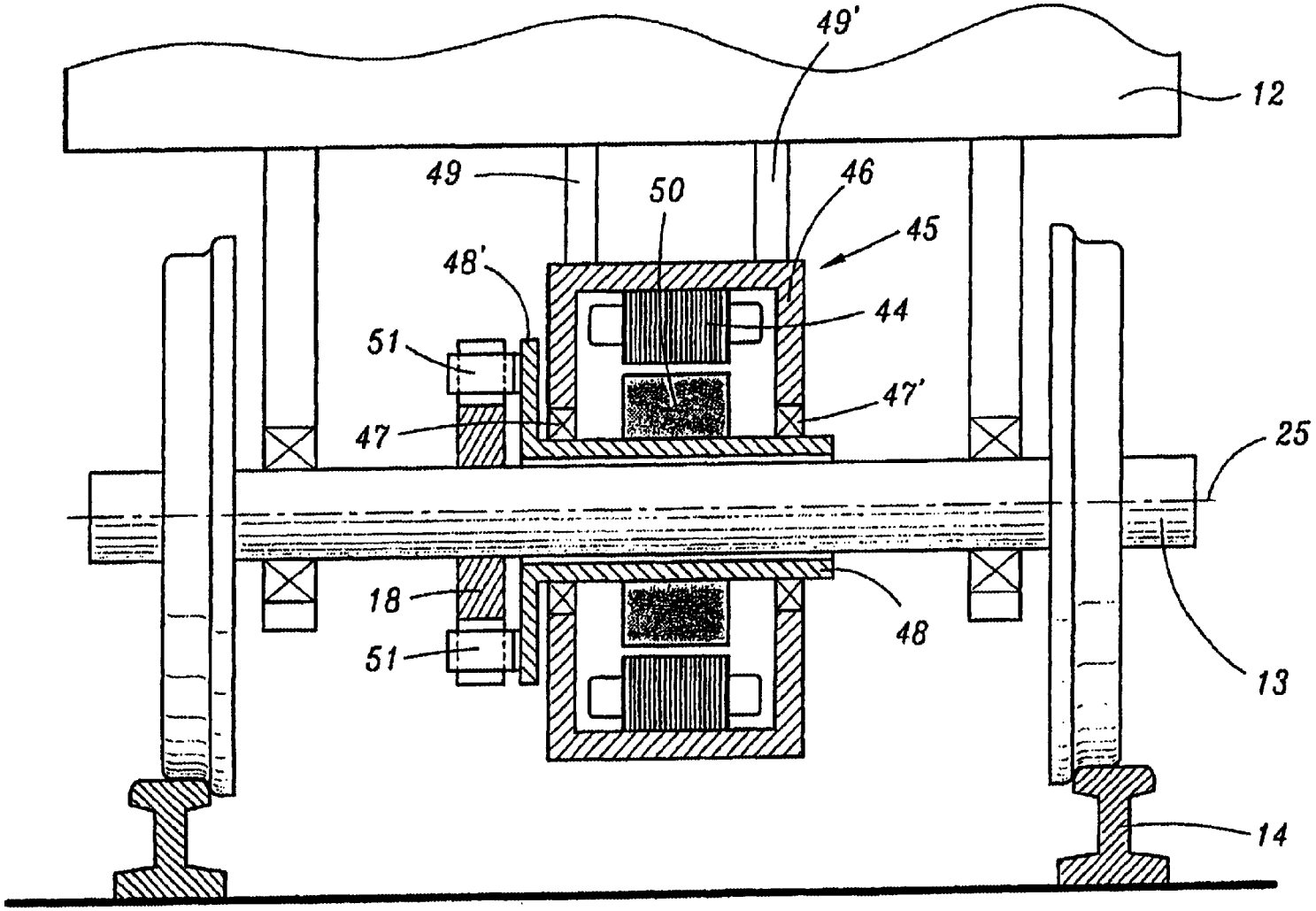
FIG. 4 is an end view in partial cross section of a drive device according to the invention in a third embodiment.

FIGS. 2, 3 and 4 show a drive device according to the invention in several embodiments. The corresponding elements in FIGS. 2, 3 and 4 have been assigned the same reference numbers.

FIG. 2 relates to a first embodiment of a drive device according to the invention used for driving a railroad vehicle, which is denoted overall by the reference number 10. This figure shows the structure 12 of the railroad vehicle and an axle 13 fastened to wheels 11 intended to move along rails 14.

The structure 12 of the vehicle is connected to the axle 13 via compliant supports 15 in which the axle 13 is mounted so as to rotate via bearings 16.

The drive device 10 comprises an electric motor 17 placed around the axle and a drive element 18 consisting of a disk fastened to the axle and located laterally with respect to the motor 17.

The motor 17 is a disk-type motor which comprises a stator 19 and a rotor 20 mounted so as to rotate inside the stator via bearings 21 and 21'.

The stator and the rotor are symmetrical bodies of revolution and have meridional sections which can be seen in FIG. 2.

The stator 19 is in the form of a disk 22 fastened at its periphery to a shell 23 by means of which the stator and the entire motor 17 are suspended from the structure 12 of the vehicle via support elements 24.

The disk 22 of the stator carries, on each of its faces, windings which generate a rotating magnetic field of axial direction, that is to say directed along the axis 25 common to the motor 17 and to the axle 13.

The rotor 20 comprises two rotor disks 26 and 26' located on each side of the stator disk 22, which disks carry windings or permanent magnets on their faces opposite those faces of the stator disk 22 which carry the windings.

The rotor may be made in two parts joined together along the junction zone 27.

The internal part of the rotor is made in the form of a shell 28, the inside diameter of which is greater than the diameter of the axle 13. Because of the presence of a radial clearance between the axle 13 and the internal part of the motor 17 consisting of the shell 28 of the rotor, the motor 17, suspended from the structure 12 of the vehicle, is not in contact with the axle, which can have a certain movement within the structure of the motor when the vehicle is running along the rails 14.

The disk 26 of the rotor 20 constitutes, on that lateral side of the motor which is located opposite the drive disk 18 fastened to the axle, the male part of a dog coupling, the dogs 29 of which, projecting outward from the motor axially, are engaged in radially directed notches (or toothing) 30 machined in the periphery of the disk 18. The dog coupling, consisting of the dogs 29 and the notches 30 in the disk 18, which provides a direct coupling link between the rotor and the disk 18 fastened to the axle 13, may, however, include a damping system or absorbing the accelerations transmitted to the axle by the rotor 20 or the wheels 11 running along the rails 14.

Because the torque is transmitted by the rotor 20 to the axle 13 in a region of the disk 18 radially remote from the axis 25 of the axle, transmission of the torque is improved. In addition, a coupling such as a dog coupling ensures that there is both very good transmission of the torque and a certain movement in the radial direction of the axle.

The motor 17 may be made in an entirely closed form, as shown in FIG. 2, the shell 23 of the stator closing the motor around the outside, the shell 28 of the rotor closing the motor around the inside and complementary closure elements 31 and 31' practically closing off the space between the stator or the rotor, in which space the rolling bearings 21 and 21' are located.

This closed construction of the motor has an advantage if the vehicle has to run along polluted tracks.

In addition, the motor may include a commutator cooling circuit 32 and 32' which makes it possible, at startup, to remove any ice from the motor. To do this, a preheated fluid is made to circulate within the cooling circuit.

FIG. 3 shows a second embodiment of a drive device according to the invention, used for driving a railroad vehicle comprising a vehicle structure 12 and an axle 13 driven by the drive device denoted overall by the reference number 40. The corresponding elements in FIGS. 2 and 3 are denoted by the same reference numbers.

The drive device 40 according to the embodiment shown in FIG. 3 comprises an electric motor 33 and the drive disk 18 fastened to the axle 13 located laterally, along the axis 25 of the axle 13, with respect to the motor 33.

The embodiment of the drive device shown in FIG. 3 differs from the embodiment shown in FIG. 2 only by the construction of the electric motor 33.

The motor 33 consists of two assemblies 34 and 35 each produced in a similar manner to the electric motor 17 of the first embodiment shown in FIG. 2 and placed in series along the axis 25 common to the axle and to the motor 33.

Each of the assemblies 34 and 35 has a stator part and a rotor part, these being substantially analogous to the stator and rotor of the motor 17 of the first embodiment.

Each of the stator parts comprises a stator disk, windings generating a rotating magnetic field being placed on each of the faces of said stator disk, and an external shell fastened to the peripheral Dart of the stator disk.

The external shells of the stator parts of the assemblies 34 and 35 are butted together in a junction zone 37, in order to form the external shell 36 of the motor 40, by means of which shell the motor is suspended via suspension elements 38 from the structure 12 of the railroad vehicle. The rotor parts of the assemblies 34 and 35 consist of three elements butted together along the axis 25 common to the motor and to the axle 13, the central element, which is connected to the end elements in regions 39 and 39', being common to the rotor part of the assembly 34 and to the rotor part of the assembly 35. The rotor of the motor 40 comprises, in its entirety, an internal shell 41 and three rotor disks, the faces of which are placed opposite those faces of the stator disks which are provided with windings. The faces of the rotor disks opposite the faces of the stator disks carry windings or permanent magnets.

The rotor is mounted so as to rotate inside the stator shell 36 via bearings 42 and 42'.

The shell 41 of the rotor has an inside diameter greater than the diameter of the axle 13 so that there is a radial clearance between the axle 13 and the shell of the rotor, allowing movement of the axle 13 with respect to the motor 40 while the railroad vehicle is travelling.

The drive disk 18 fastened to the axle 13 is located laterally with respect to the motor 40, along the axis 25 of the motor and of the axle, on the same side as the assembly 34. The drive disk 18 has, in its peripheral part, notches or drive toothing in which dogs 43 fastened to the rotor of the motor 40 are engaged.

As in the case of the embodiment shown in FIG. 2, the dog coupling, consisting of the dogs 43 and the peripheral part of the disk 18, constitutes a directly coupled transmission between the rotor of the motor 40 and the axle 13.

The region where the forces are transmitted Is also shifted a certain radial distance away from the axis 25 common to the motor and the axle. The dog transmission also allows a certain radial movement between the drive disk 18 fastened to the axle and the motor suspended from the structure 12 of the motor vehicle.

In the case of the drive device according to the first embodiment shown in FIG. 2 or in the case of the second embodiment shown in FIG. 3, the drive disk 18 may be placed laterally, on one side of the motor or the other, or else a drive disk may be placed each side of the motor, the rotor of the motor having, in this case, direct drive parts such as dogs at each of its axial ends.

The construction of a motor such as the motor 40 from several modular assemblies allows motors of different power to be assembled from modules which may be identical.

As shown in FIG. 3, the motor 40 comprising two assemblies 34 and 35 may be produced in a completely closed form, just like the motor 17 of the first embodiment.

FIG. 4 shows a third embodiment of the drive device according to the invention applied to driving a railroad vehicle having a vehicle structure and at least one driving axle.

In the case of the drive devices according to the First and second embodiments, the electric drive motor 17 or 40 is a disk motor.

The drive device according to the third embodiment, shown in FIG. 4, differs from the first and second embodiments only by the construction of the drive motor 45 which is a motor of cylindrical structure.

The motor 45 is produced and placed so as to lie around the axle 13, without any contact with the axle. The motor 45 of cylindrical structure comprises a stator 46 and a rotor 48 mounted so as to rotate in the stator, about the axis 25 common to the axle and to the motor, via bearings 47 and 47'.

The stator 46, which has a cylindrical annular shape, is suspended from the structure 12 of the railroad vehicle via fixing elements 49 and 49' connected to the cylindrical lateral surface of the stator 46. The rotor 48 is in the form of a cylindrical shell fastened, at one of its ends, to an annular disk 48'.

The stator 46 carries, on its cylindrical internal surface, windings 44 which generate a magnetic field rotating around the axis 25 of the motor. The rotor 48 carries, on the external surface of its cylindrical part, windings or permanent magnets 50 opposite the windings 44 of the stator. The cylindrical part of the rotor 48 has an inside diameter greater than the diameter of the axle 13 so that there is a radial clearance between the external surface of the axle and the internal surface of the rotor.

The disk-shaped end Dart 48' of the stator carries drive dogs 51 which engage in notches or in toothing of the peripheral part of the drive disk 18. Thus, the disk 18 and the axle are driven directly by the rotor 48. However, as in the case of the first and second embodiments, the dog coupling, consisting of the dogs 51 and the peripheral part of the drive element 18, may be combined with a damping system making t possible to absorb the drive forces and to avoid jolts during accelerations or decelerations of the railroad vehicle.

As in the case of the first and second embodiments, the transmission of the forces is shifted a certain radial distance from the axis 25 of the axle and movement between the axle and the motor is possible despite the dogs of the dog coupling meshing in the notches for accommodating the dogs of the peripheral part of the drive disk 18.

The drive device according to the invention firstly has the advantages obtained in all the cases in which a motor placed around the axle is used, this arrangement of the motor making it possible, in particular, to bring the structure of the vehicle closer to the axle and therefore to lower the vehicle and increase its stabilty during use. In order to obtain the most compact arrangement possible, an electric motor is used whose overall outside diameter is less than the diameter of the wheels of the vehicle. In this case, the motor is entirely housed within the wheel train.

The electric motor of the drive device according to the invention is entirely suspended from the structure of the vehicle. This makes it possible to improve the traction performance of the drive device and to limit the transmission of vibrations, because the axle is not in contact with the motor.

The forces are transmitted at a certain radial distance from the axis of the axle, which distance can be optimized by choosing the dimensions of the disk or other drive element fastened to the axle.

Furthermore, because there is a clearance between the rotor and the axle and because a coupling having a certain freedom of radial movement is used, the axle is virtually free with respect to the drive motor.

The invention is not limited to the embodiments that have been described.

Direct coupling of the drive element fastened to the axle via the rotor may be achieved laterally, on one side of the motor or the other, or on both sides. In the case of a dog coupling, the dogs may be fastened to a part of the disk-shaped rotor which is placed at least at one of the axial ends of the motor.

The electric motor, when it is of the disk type, may have two or more stator disks and three or more rotor disks, these being arranged so that each stator disk is inserted, in the axial direction of the motor, between two rotor disks.

Instead of a single motor or a single motor assembly, several motors or several motor assemblies may be used, the rotors of which each ensure directly-coupled transmission of a drive torque to a drive element fastened to the axle. In this case, it is possible to use all the motors or motor assemblies at the same time or, optionally, only certain of these motors or motor assemblies.

The motor or motors or motor assemblies may be placed in arrangements which are centered or are symmetrical along the axial direction of the axle, or else in off-center or nonsymmetrical arrangements.

When the motor is of the disk type, it comprises in general at least one stator disk and one rotor disk having opposing faces, a plurality of electrical windings being fixed to the face of the stator disk and a plurality of windings or Permanent magnets being fixed to the opposing face of the rotor disk.

The coupling between the rotor and the element for driving the axle may be produced not only in the form of a dog coupling but also in any other form, such as a disk coupling. In all cases, the coupling between the rotor and the drive element must be a direct coupling allowing a certain movement perpendicular to the axis of the axle.

The drive device according to the invention can be applied not only to the driving of railroad vehicles but also in the case of road vehicles or all-terrain vehicles.

What is claimed is:

1. A device for driving a vehicle mounted on at least one driving axle fitted with wheels, the device comprising:

at least one electric motor having a stator and a rotor mounted so as to rotate with respect to the stator, the rotor placed around the axle but not in contact with the axle;

a drive element fastened to the axle and extending radially from the axle;

the drive element being a drive disk coaxially fastened to the axle and located laterally with respect to the electric motor, along the axial direction of the axle, the drive element driving the axle;

the motor having at least one stator disk and at least one rotor disk, the rotor disk and stator disk having opposing faces;

a plurality of electrical windings being fixed to the face of the stator disk;

a plurality of windings or permanent magnets being fixed to the opposing face of the rotor disk; and the rotor disk fastened to means for directly engaging elements in a peripheral region of the drive disk, remote from an axis of the axle.

2. The device as claimed in claim 1, wherein the direct engaging means comprises dogs which project outwardly from the motor in the axial direction, and the engaging elements are notches formed in the peripheral region of the drive disk, the dogs of the rotor and the peripheral part of the drive disk constituting a dog coupling having movement in the radial direction.

3. The device as claimed in claim 2, wherein a damping system is combined with the dog coupling so as to avoid jolts during acceleration or deceleration of the vehicle.

4. The device as claimed in claim 1, wherein the stator of the electric motor includes a stator disk carrying electrical windings on each of its faces; and further wherein the rotor of the motor includes two rotor disks placed on either side of the stator disk, each rotor disk having, on one of its faces opposing a face of the stator disk, windings or permanent magnets.

5. The device as claimed in claim 1, wherein the stator of the electric motor includes at least two stator disks provided with electrical windings on their faces and the rotor of the motor includes at least three rotor disks arranged so that a stator disk is inserted, along the axial direction of a motor, between two adjacent rotor disks, the rotor disks having permanent magnets on their faces opposing the faces of the stator disks.

6. The devices claimed in claim 1, wherein the dogs are fastened to at least one rotor disk placed at one axial end of the motor.

7. The devices claimed in claim 1, wherein the rotor of the motor engages with the element for driving the axle via a disk coupling.

* * * * *